US010692644B2

(12) United States Patent
Muneuchi et al.

(10) Patent No.: US 10,692,644 B2
(45) Date of Patent: Jun. 23, 2020

(54) ELECTRONIC COMPONENT AND METHOD OF MANUFACTURING THE SAME

(71) Applicant: Murata Manufacturing Co., Ltd., Kyoto (JP)

(72) Inventors: Keita Muneuchi, Nagaokakyo (JP); Eiji Iso, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 15/840,932

(22) Filed: Dec. 13, 2017

(65) Prior Publication Data

US 2018/0182533 A1 Jun. 28, 2018

(30) Foreign Application Priority Data

Dec. 22, 2016 (JP) ..... 2016-249657

(51) Int. Cl.

| | |
|---|---|
| ***H01F 27/02*** | (2006.01) |
| ***H01F 27/28*** | (2006.01) |
| ***H01F 27/255*** | (2006.01) |
| ***H01F 27/29*** | (2006.01) |
| ***H01F 41/061*** | (2016.01) |
| ***H01F 17/04*** | (2006.01) |
| ***H01F 27/36*** | (2006.01) |
| *H01F 41/076* | (2016.01) |
| *H01F 27/32* | (2006.01) |

(52) U.S. Cl.

CPC ..... *H01F 27/2828* (2013.01); *H01F 17/04* (2013.01); *H01F 27/255* (2013.01); *H01F 27/29* (2013.01); *H01F 27/365* (2013.01); *H01F 41/061* (2016.01); *H01F 27/2871* (2013.01); *H01F 27/324* (2013.01); *H01F 41/076* (2016.01); *H01F 2017/048* (2013.01)

(58) Field of Classification Search

CPC ... H01F 27/2828; H01F 41/061; H01F 41/076
USPC ..... 336/83
See application file for complete search history.

(56) References Cited

U.S. PATENT DOCUMENTS 8,723,629 B1 * 5/2014 Liu ..... H01F 27/29 336/83
2013/0234819 A1 9/2013 Yoo et al.
2013/0307655 A1 11/2013 Saito et al.
(Continued)

FOREIGN PATENT DOCUMENTS

CN 103310945 A 9/2013
CN 103339695 A 10/2013
JP 62104112 A * 5/1987
(Continued)

OTHER PUBLICATIONS

English translation of JP2013110184 (Year: 2013).*
(Continued)

*Primary Examiner* — Ronald Hinson
(74) *Attorney, Agent, or Firm* — Studebaker & Brackett PC

(57) ABSTRACT

An electronic component includes at least one coil including a winding part and lead-out end parts at both ends thereof, and a magnetic molded body having a mounting surface with the coil incorporated therein. The lead-out end parts are led out toward the mounting surface such that end surfaces of the lead-out end parts are arranged on the same plane as the mounting surface.

6 Claims, 16 Drawing Sheets

(56) References Cited

U.S. PATENT DOCUMENTS

2015/0187486 A1* 7/2015 Lim ..... H01F 17/0013
336/192

FOREIGN PATENT DOCUMENTS

| | | | |
|---|---|---|---|
| JP | 2011-003761 | A | 1/2011 |
| KR | 10-2013-0101849 | A | 9/2013 |
| KR | 10-2013-0139993 | A | 12/2013 |
| KR | 10-2015-0114798 | A | 10/2015 |
| KR | 10-2016-0092673 | A | 8/2016 |

OTHER PUBLICATIONS

English abstract of JP62104112 (Year: 1987).*
An Office Action mailed by the China National Intellectual Property Administration dated Aug. 2, 2019, which corresponds to Chinese Patent Application No. 201711393600.9 and is related to U.S. Appl. No. 15/840,932 with English language translation.
An Office Action; "Notification of Reasons for Refusal," mailed by the Korean Patent Office dated Apr. 19, 2019, which corresponds to Korean Patent Application No. 10-2017-0167497 and is related to U.S. Appl. No. 15/840,932; with English language translation.
An Office Action mailed by the Korean Intellectual Property Office dated Oct. 30, 2019, which corresponds to Korean Patent Application No. 10-2017-0167497 and is related to U.S. Appl. No. 15/840,932 with English language translation.

* cited by examiner

ELECTRONIC COMPONENT AND METHOD OF MANUFACTURING THE SAME

CROSS-REFERENCE TO RELATED APPLICATIONS

This application claims priority to Japanese Patent Application No. 2016-249657, filed on Dec. 22, 2016, the disclosure of which is hereby incorporated by reference in its entirety.

TECHNICAL FIELD

The present disclosure relates to an electronic component and a method of manufacturing the same.

BACKGROUND

An electronic component having a coil sealed with a magnetic sheet is conventionally widely used. In the molded coil described in Japanese Laid-Open Patent Publication No. 2011-3761, flat plate-shaped magnetic bodies sandwiching a plurality of coils are further pressurized to seal the coils. The magnetic bodies including the coil are then cut into a predetermined shape to acquire a molded coil. The molded coil has both ends of the coil led out from side surfaces thereof and connected to external terminals. The external terminals are formed over the side surfaces and a mounting surface of the molded coil.

SUMMARY

An electronic component includes at least one coil including a winding part and lead-out end parts at both ends, and a magnetic molded body having a mounting surface with the coil incorporated therein. The lead-out end parts are led out toward the mounting surface such that end surfaces of the lead-out end parts are arranged on the same plane as the mounting surface.

A method of manufacturing an electronic component includes acquiring a stacked precursor, pressurizing the stacked precursor to acquire a magnetic sheet stacked body, and cutting the magnetic sheet stacked body to form a mounting surface so as to acquire a magnetic molded body. Acquiring the stacked precursor includes arranging a plurality of coils on an upper surface of a magnetic sheet such that the winding axis of the coils is orthogonal to the upper surface of the magnetic sheet and that all the lead-out end parts are led out in the same direction and stacking another magnetic sheet on the arranged coils. The stacked precursor is pressurized in the winding axis direction of the coils to acquire a magnetic sheet stacked body having a plurality of the coils incorporated therein. The magnetic sheet stacked body is cut together with the lead-out end parts at both ends of the coils along a plane parallel to the winding axis direction of the coils to form a mounting surface so as to acquire a magnetic molded body with end surfaces of the lead-out end parts arranged on the same plane as the mounting surface.

DETAILED DESCRIPTION

Figure 1A:
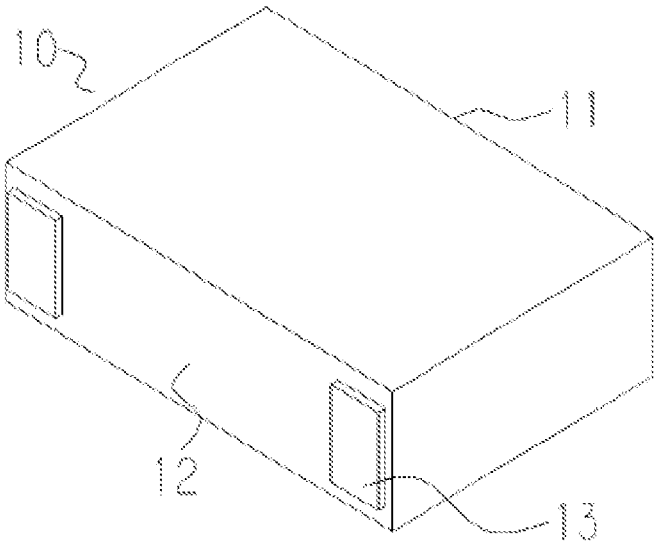
FIG. 1A is a perspective view of an electronic component of a first example.

In the molded coil disclosed in Japanese Laid-Open Patent Publication No. 2011-3761, the mounting surface is different from the surfaces to which both ends of the coil are led out. This causes a problem that external terminals extending over multiple surfaces of the molded coil are required and that extra external terminals are formed on other than the mounting surface. Additionally, a step of forming external terminals on multiple surfaces is necessary, which causes a problem that time and effort are required for manufacturing.

The present disclosure provides an electronic component without extra external terminals on other than the mounting surface and a method of manufacturing the same.

An electronic component includes at least one coil including a winding part and lead-out end parts at both ends, and a magnetic molded body having a mounting surface with the coil incorporated therein. The lead-out end parts are led out toward the mounting surface such that end surfaces of the lead-out end parts are arranged on the same plane as the mounting surface.

A method of manufacturing an electronic component includes acquiring a stacked precursor, pressurizing the stacked precursor in the winding axis direction of the coils to acquire a magnetic sheet stacked body having a plurality of the coils incorporated therein, and cutting the magnetic sheet stacked body together with the lead-out end parts at both ends of each of the coils along a plane parallel to the winding axis direction of the coils to form a mounting surface so as to acquire a magnetic molded body with end surfaces of the lead-out end parts arranged on the same plane as the mounting surface. Acquiring a stacked precursor includes arranging a plurality of coils on an upper surface of a magnetic sheet such that the winding axis of the coils is orthogonal to the upper surface of the magnetic sheet and that all the lead-out end parts are led out in the same direction and stacking another magnetic sheet on the arranged coils.

An electronic component includes at least one coil including a winding part and lead-out end parts at both ends and a magnetic molded body having a mounting surface with the coil incorporated therein. The lead-out end parts are led out toward the mounting surface such that end surfaces of the lead-out end parts are arranged on the same plane as the mounting surface. Therefore, external terminals need to be formed only on the mounting surface, and no extra external terminal needs to be formed on other than the mounting surface for connection to the lead-out end part of the coil. A material cost for forming the external terminals can be reduced, and the number of steps required for manufacturing can also be reduced. Furthermore, the electronic component constitutes an inductor, and the winding axis of the coil is arranged in parallel with the mounting surface.

The electronic component may have a plurality of coils, and at least two of the coils may have the respective winding parts stacked in a winding axis direction of the coils. As a result, a multi-phase inductor with bottom electrodes can be formed.

The electronic component may have a plurality of coils, and at least two coils may have respective winding parts stacked in the winding axis direction of the coils with an intermediate layer disposed between the coils. As a result, desired characteristics can be imparted to the multiphase inductor with bottom electrodes.

A method of manufacturing an electronic component is including at least one coil including a winding part and lead-out end parts at both ends and a magnetic molded body having a mounting surface with the coil incorporated therein. The method includes acquiring a stacked precursor having a plurality of coils arranged between magnetic sheets, pressurizing the stacked precursor in the winding axis direction of the coils to acquire a magnetic sheet stacked body having a plurality of the coils incorporated therein, and cutting the magnetic sheet stacked body together with the lead-out end parts at both ends of each of the coils along a plane parallel to the winding axis direction of the coils to form a mounting surface so as to acquire a magnetic molded body with end surfaces of the lead-out end parts arranged on the same plane as the mounting surface. Acquiring a stacked precursor includes arranging a plurality of the coils on an upper surface of a magnetic sheet such that the winding axis of the coils is orthogonal to the upper surface of the magnetic sheet and that all the lead-out end parts are led out in the same direction and stacking a magnetic sheet on the arranged coils. As a result, the external terminals may be formed only on the mounting surface, and therefore, the material cost and the number of steps can be reduced.

The method may further include forming external terminals connected to the lead-out end parts on the mounting surface of the magnetic molded body. As a result, the electronic component with excellent mountability can be configured.

In the method, acquiring the stacked precursor may include arranging a plurality of the coils on an upper surface of a magnetic sheet such that the winding axis of the coils is orthogonal to the upper surface of the magnetic sheet and that all the lead-out end parts are led out in the same direction and stacking a magnetic sheet and additional coils on the arranged coils at least once, and further stacking another magnetic sheet on the additional coils, and the additional coils may be arranged such that the winding parts of the additional coils are stacked in the winding axis direction of the coils above the winding parts of the coils arranged between the magnetic sheets via the stacked magnetic sheet and that the lead-out end parts of all the coils are led out in the same direction. As a result, the electronic component having a plurality of coils incorporated therein can be acquired by simply adding a small number of man-hours without significantly changing a mounting area.

In the method, acquiring the stacked precursor may include arranging the coils on an upper surface of a magnetic sheet such that the winding axis of the coils is orthogonal to the upper surface of the magnetic sheet and that all the lead-out end parts are led out in the same direction and stacking magnetic sheets including an intermediate sheet and additional coils on the arranged coils at least once, and further stacking a magnetic sheet on the additional coils. The magnetic sheets including an intermediate sheet are formed by stacking a magnetic sheet, an intermediate sheet, and a magnetic sheet in this order. The additional coils may be arranged such that the winding parts of the additional coils are stacked in the winding axis direction of the coils above the winding parts of the coils arranged between the magnetic sheets via the stacked magnetic sheet and that the lead-out end parts of all the coils are led out in the same direction. As a result, the electronic component with adjusted coupling of the coils or the electronic component with reduced distance between the coils can be acquired by simply adding a small number of man-hours.

Embodiments of the present disclosure will now be described with reference to the drawings. It is noted that the embodiments described below exemplify the electronic component for embodying the technical ideas of the present disclosure and that the present disclosure does not limit the surface-mount inductor to the following. The members described in claims are not limited to the members of the embodiments in any way. Particularly, dimensions, materials, shapes, relative arrangements, etc. of constituent components described in the embodiments are not intended to limit the scope of the present disclosure only thereto unless otherwise specifically described and are merely illustrative examples. In the figures, the same portions are denoted by the same reference numerals. In consideration of facilitation of description or understanding of the main points, embodiments are separately described for convenience; however, configurations shown in different embodiments can partially be substituted or combined. In this description, the term "step" refers not only to an independent step, but also to a step that cannot clearly be differentiated from other steps, as long as the intended purpose of the step is achieved.

First Example

Figure 1B:
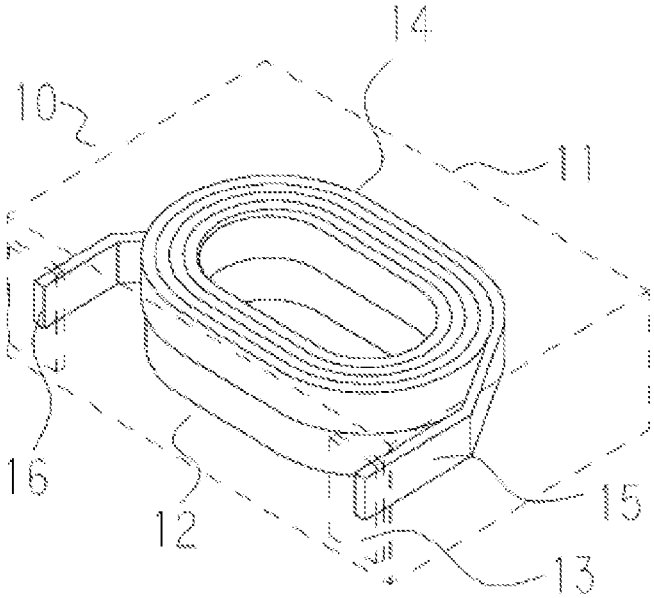
FIG. 1B is a transparent perspective view of the electronic component of the first example.
Figure 2A:
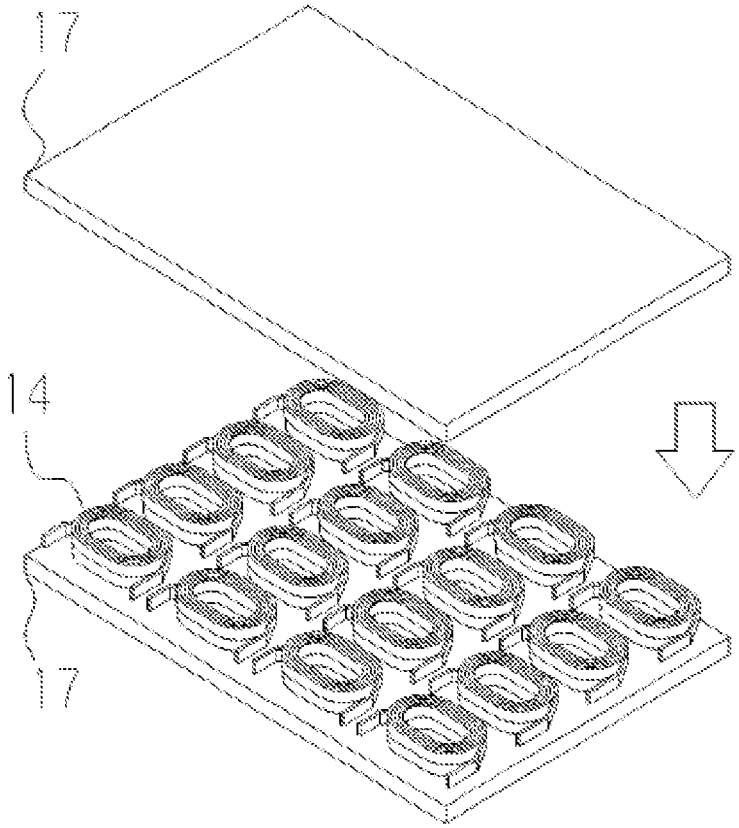
FIG. 2A is a schematic for explaining a method of manufacturing the electronic component of the first example.
Figure 2B:
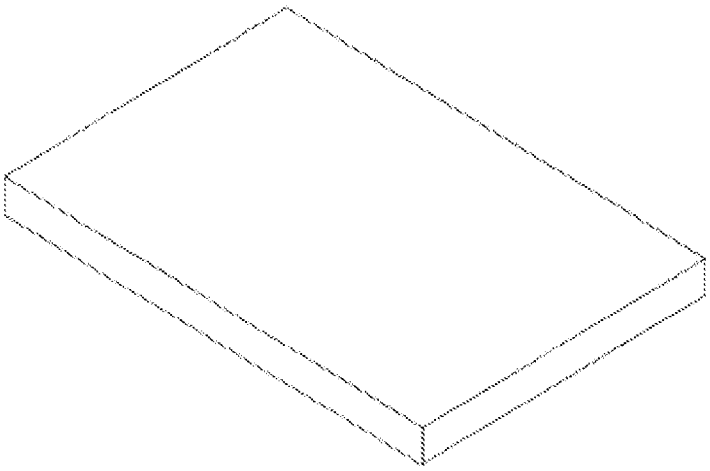
FIG. 2B is a schematic for explaining the method of manufacturing the electronic component of the first example.
Figure 2C:
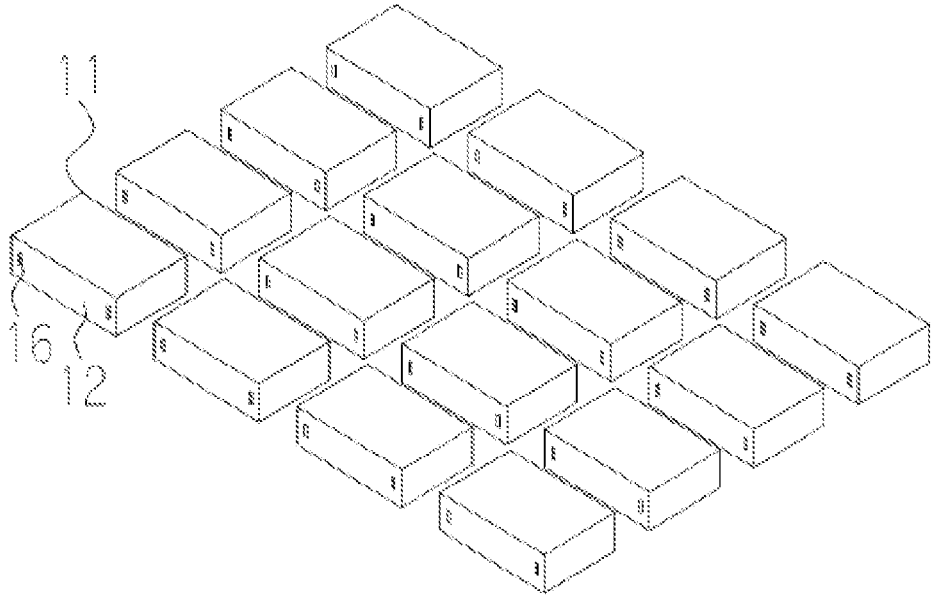
FIG. 2C is a schematic for explaining the method of manufacturing the electronic component of the first example.
Figure 2D:
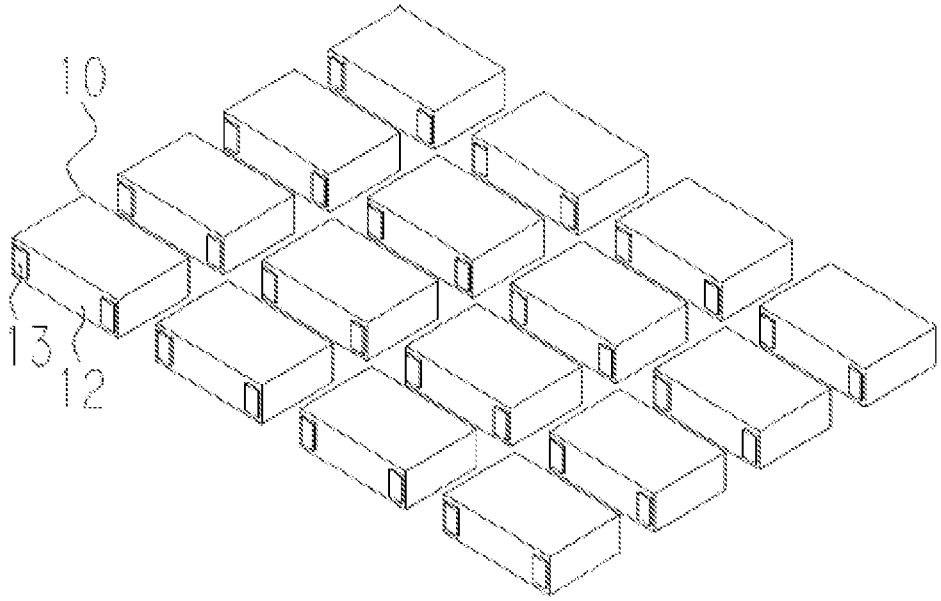
FIG. 2D is a schematic for explaining the method of manufacturing the electronic component of the first example.

FIG. 1A is a perspective view of an electronic component of a first example of this embodiment, and FIG. 1B is a transparent perspective view of the electronic component of the first example of the present disclosure. FIGS. 2A to 2D are schematics for explaining a method of manufacturing the electronic component of the first example of the present disclosure. FIG. 2A is a perspective view of a step of arranging a plurality of coils on an upper surface of a magnetic sheet (hereinafter referred to as an arrangement step). FIG. 2B is a perspective view of a step of sealing the plurality of coils in a magnetic sheet stacked body (hereinafter referred to as a sealing step). FIG. 2C is a perspective view of a step of cutting the magnetic sheet stacked body with the coils sealed therein to acquire a magnetic molded body (hereinafter referred to as a cutting step). FIG. 2D is a perspective view of a step of forming external terminals on a mounting surface of the magnetic molded body (hereinafter referred to as a terminal step).

As shown in FIG. 1A, an electronic component 10 of the first example includes a magnetic molded body 11 formed by pressure molding of a mixture of a magnetic powder and a resin. The electronic component 10 constitutes an inductor, for example. The magnetic molded body 11 has external terminals 13 on the mounting surface 12. As shown in FIG. 1B, a coil 14 formed by winding a conductive wire having a rectangular cross section is incorporated inside the magnetic molded body 11. The coil 14 has a winding part of the conductive wire and lead-out end parts 15 led out from the winding part, and the lead-out end parts 15 are disposed at both ends of the coil 14. The lead-out end parts 15 are both led out in the direction of the mounting surface and has respective end surfaces 16 of the conductive wire at tips. The end surfaces 16 are electrically connected to the external terminals 13 arranged on the mounting surface.

A method of manufacturing the electronic component of the first example will be described. The electronic component is manufactured by using a magnetic sheet that is a mixture of a magnetic powder and a resin pressure-molded into a flat plate shape, and a coil formed by winding a conductive wire having a rectangular cross section.

First, the arrangement step of arranging the coils is executed. As shown in FIG. 2A, a plurality of the coils 14 is arranged on a coil arrangement surface (also referred to as an upper surface) that is one of surfaces of a magnetic sheet 17. The lead-out end parts 15 of the arranged coils 14 are all led out in the same direction. On the plurality of the coils 14 arranged on the upper surface of the magnetic sheet 17, another magnetic sheet 17 is stacked and disposed to acquire a stacked precursor having a plurality of coils arranged between the magnetic sheets.

Subsequently, the sealing step of sealing the coils with a magnetic sheet is executed. The stacked precursor used at the sealing step has a plurality of the coils 14 sandwiched between the two magnetic sheets 17 from both sides in the winding axis direction thereof. The stacked precursor is put into a mold not shown and pressure-molded to acquire a magnetic sheet stacked body having the plurality of the coils 14 sealed in an integrated magnetic sheet as shown in FIG. 2B. The lead-out end parts 15 of the sealed coils 14 all face in the same direction.

Subsequently, the cutting step of cutting a magnetic sheet stacked body including coils is executed. As shown in FIG. 2C, the magnetic sheet stacked body with the coils 14 sealed therein is cut together with the lead-out end parts along a first cutting plane parallel to the winding axis direction of the coils and intersecting with the lead-out end parts of each of the coils to form a mounting surface. Consequently, cut surfaces of the lead-out end parts, i.e., the end surfaces 16 of the lead-out end parts, are arranged on the same plane as the mounting surface 12. In FIG. 2C, the magnetic sheet stacked body is cut along a second cutting plane parallel to the winding axis direction of the coils and orthogonal to the mounting surface, in addition to the first cutting plane forming the mounting surface 12, to acquire the magnetic molded bodies 11 each having the one coil 14 incorporated therein. Each of the magnetic molded bodies 11 has the one coil 14 incorporated therein, and the end surfaces 16 of the lead-out end parts 15 of the coil 14 are arranged and exposed on the mounting surface 12 of the magnetic molded body 11. Therefore, the mounting surface 12 is substantially flush with the end surfaces 16 of the lead-out end parts of the coil. The winding axis direction of the coil is parallel to the mounting surface. Furthermore, at the cutting step, the lead-out end parts cut off from the coil of another magnetic molded body remain on a surface facing the mounting surface may be cut and removed along a surface facing the mounting surface.

Lastly, the terminal step of forming external terminals is executed. As shown in FIG. 2D, the external terminals 13 are formed on the end surfaces 16 exposed on each of the mounting surfaces 12 to acquire the electronic component 10. The external terminals 13 are formed by applying a paste metal, for example. The external terminals 13 are electrically connected to the end surfaces 16 of the coil 14. In the manufacturing method of FIG. 2, the lead-out end parts 15 of the coil 14 are exposed on the mounting surface when the mounting surface is formed, so that no external terminal needs to be formed on other than the mounting surface for connection to the coil.

As described above, the electronic component is acquired by executing the arrangement step, the sealing step, the cutting step, and the terminal step. Since the electronic component acquired in this way has the external terminals only on the mounting surface, the material cost can be reduced. Furthermore, in such a method of manufacturing an electronic component, the external terminals may be formed only on the mounting surface, so that the number of man-hours can be reduced.

The shape of the magnetic molded body is not limited to a rectangular parallelepiped. Other shapes may be used as long as the mounting surface is included. The conductive wire constituting the coil is not limited to a rectangular cross section. For example, the conductive wire may have a circular cross section or other shapes. The method of forming the external terminals is not limited to the method of applying a paste metal. Other methods such as sputtering may be used.

Second Example

An electronic component of a second example will be described with reference to FIGS. 3A to 4D. The same reference numerals are given to the constituent elements in common with the already described example. In the electronic component of the second example, two coils are incorporated in a magnetic molded body with winding parts thereof stacked in the winding axis direction of the coils.

Figure 3A:
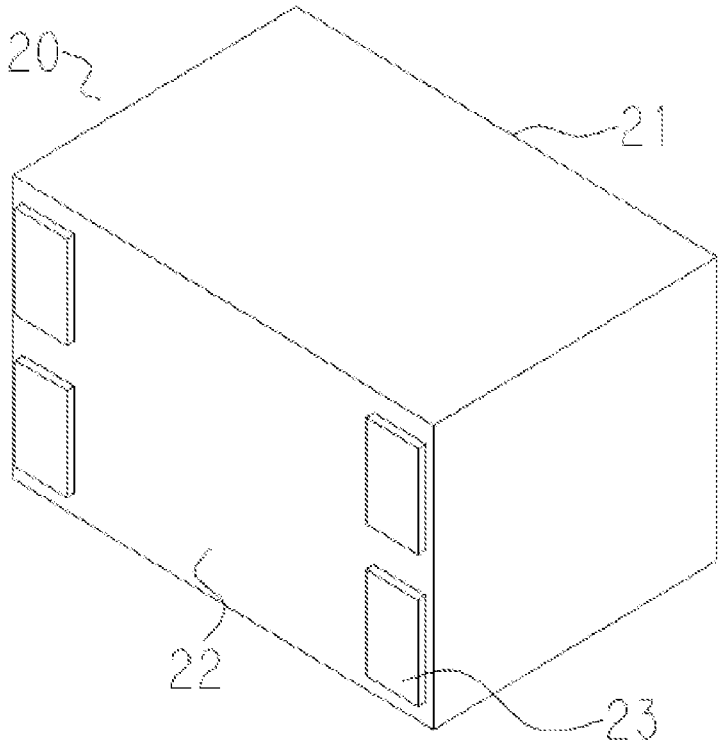
FIG. 3A is a perspective view of an electronic component of a second example.
Figure 3B:
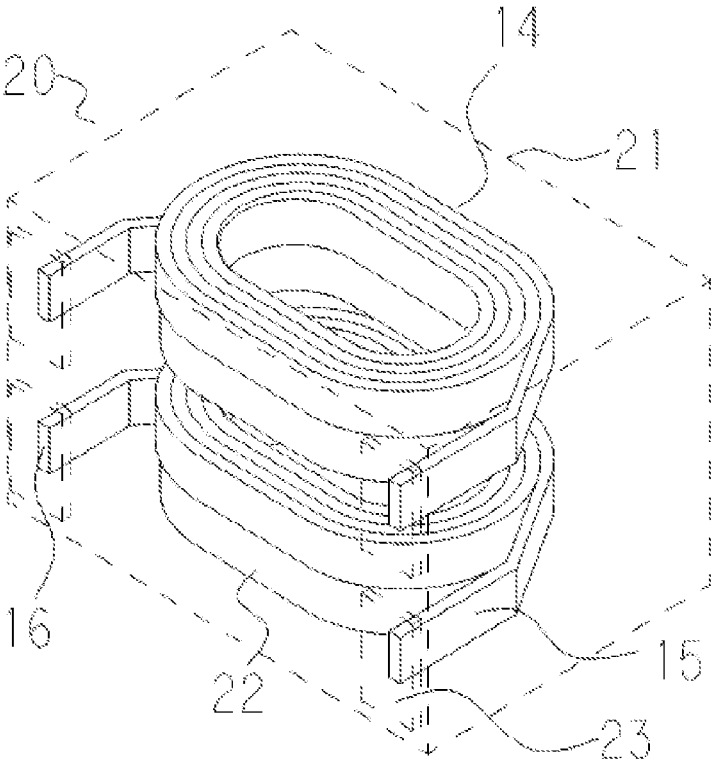
FIG. 3B is a transparent perspective view of the electronic component of the second example.
Figure 4A:
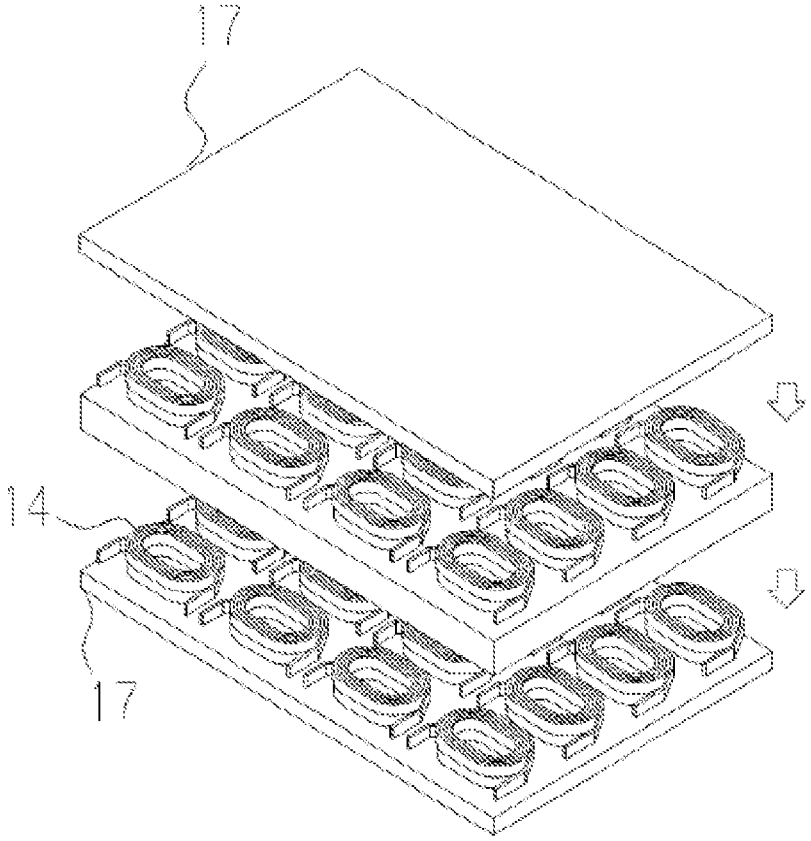
FIG. 4A is a schematic for explaining a method of manufacturing the electronic component of the second example.
Figure 4B:
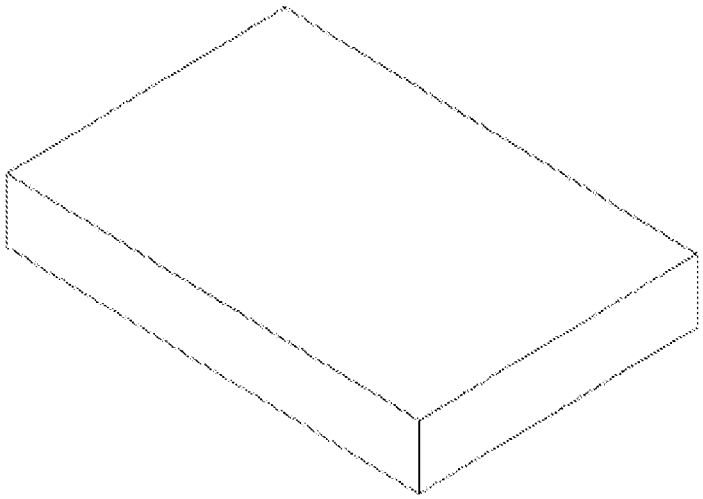
FIG. 4B is a schematic for explaining the method of manufacturing the electronic component of the second example.
Figure 4C:
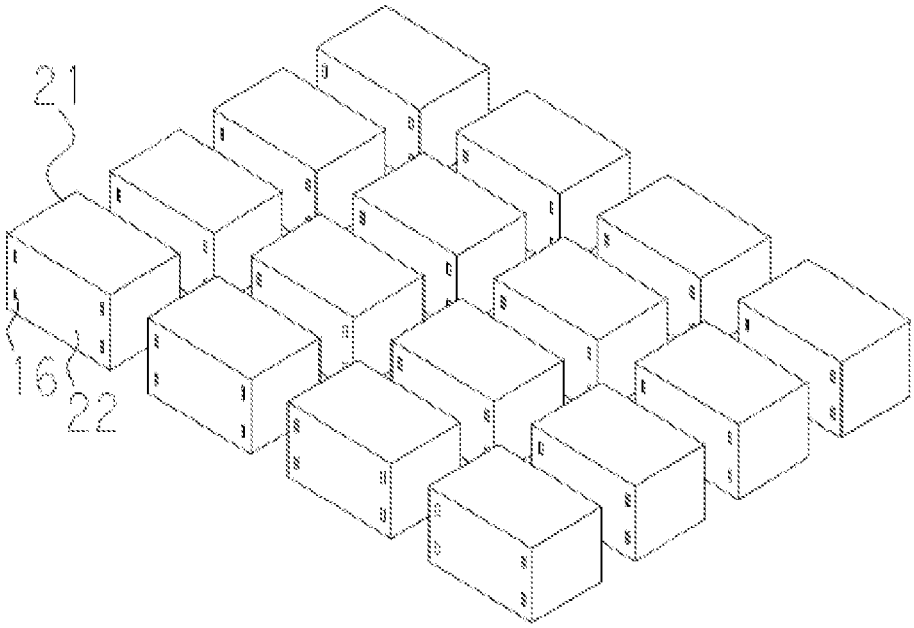
FIG. 4C is a schematic for explaining the method of manufacturing the electronic component of the second example.
Figure 4D:
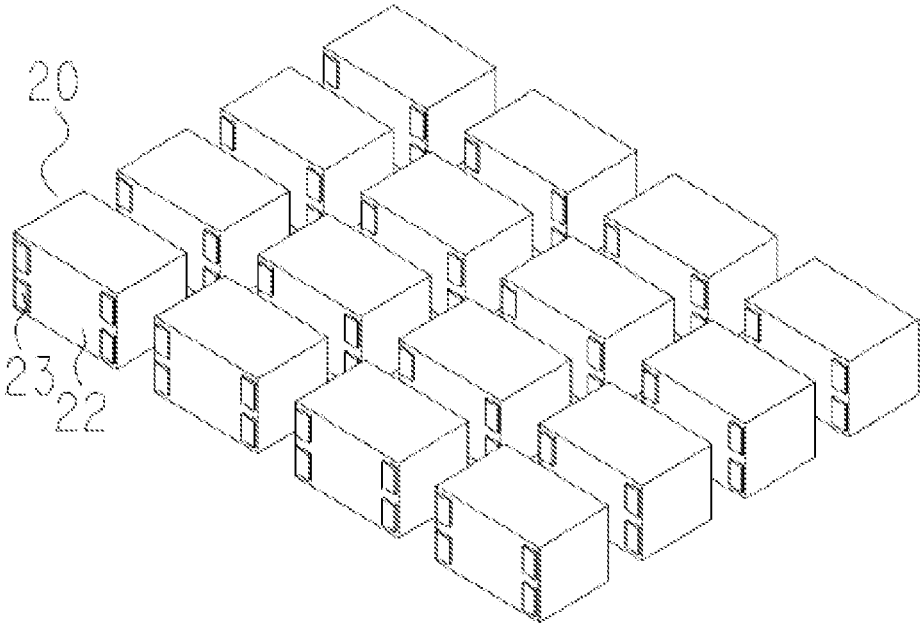
FIG. 4D is a schematic for explaining the method of manufacturing the electronic component of the second example.

FIG. 3A is a perspective view of an electronic component 20 of the second example of this embodiment and FIG. 3B is a transparent perspective view of the electronic component 20 of the second example of this embodiment. FIGS. 4A to 4D are schematics for explaining a method of manufacturing the electronic component of the second example of the present disclosure. FIG. 4A is a perspective view of a step of repeating the arrangement step executed in the first example to arrange a plurality of magnetic sheets each having a plurality of coils arranged on an upper surface, in the winding axis direction of the coils (hereinafter also referred to as a multilayer arrangement step). FIG. 4B is a perspective view of a sealing step. FIG. 4C is a perspective view of a cutting step. FIG. 4D is a perspective view of a terminal step.

As shown in FIG. 3A, the electronic component 20 of the second example includes a magnetic molded body 21 formed by pressure molding of a mixture of a magnetic powder and a resin. The magnetic molded body 21 has external terminals 23 on a mounting surface 22. As shown in FIG. 3B, the two coils 14, each formed by winding a conductive wire having a rectangular cross section, are incorporated inside the magnetic molded body 21. The coil 14 has a winding part of the conductive wire and the lead-out end parts 15 led out from the winding part, and the lead-out end parts 15 are disposed at both ends of the coil 14. The two coils 14 are arranged such that the respective winding parts overlap each other in the winding axis direction via a layer containing the magnetic powder and the resin. The coils 14 each have the lead-out end parts 15 at both ends. The lead-out end parts 15 are both led out toward the mounting surface 22 and have the respective end surfaces 16 of the conductive wire at tips. The end surfaces 16 are arranged on the same plane as the mounting surface 22 and electrically connected to the external terminals 23.

A method of manufacturing the electronic component of the second example will be described. As in the first example, the electronic component of the second example is manufactured by using a magnetic sheet that is a mixture of a magnetic powder and a resin pressure-molded into a flat plate shape, and a coil formed by winding a conductive wire having a rectangular cross section.

First, the multilayer arrangement step of arranging the coils in multiple layers is executed. The arrangement step executed in the first example is repeated twice to acquire the two magnetic sheets 17 each having a plurality of the coils 14 arranged on the upper surface. As shown in FIG. 4A, the two magnetic sheets 17 each having a plurality of the coils 14 arranged on the upper surface are overlapped such that the winding parts of the coils 14 are stacked in the winding axis direction via the magnetic sheet 17. The lead-out end parts 15 of the arranged coils 14 are all led out in the same direction. On the plurality of the coils 14 arranged on the uppermost stage, the additional magnetic sheet 17 is stacked and disposed to acquire a stacked precursor.

The stacked precursor is formed by stacking the two magnetic sheets 17 each having a plurality of the coils 14 arranged on the upper surface in FIG. 4A, or may be formed by sequentially stacking the magnetic sheet 17 and additional coils. Specifically, the stacked precursor may be formed by stacking a further magnetic sheet 17 on the plurality of the coils 14 arranged on the magnetic sheet 17, arranging the additional coils 14 on the stacked the further magnetic sheet 17 such that the winding parts are stacked in the winding axis direction via the further magnetic sheet 17 and that the lead-out end parts 15 are all led out in the same direction, and stacking the additional magnetic sheet 17 on the arranged additional coils 14.

Subsequently, the sealing step of sealing the coils with a magnetic sheet is executed. The stacked precursor used at the sealing step has a plurality of the coils 14 sandwiched between the two magnetic sheets 17 from both sides in the winding axis direction, and the respective winding parts of the coils 14 arranged on the different magnetic sheets are stacked via the magnetic sheet 17 in the winding axis direction. The stacked precursor is put into a mold not shown and pressure-molded to acquire a magnetic sheet stacked body having the plurality of the coils 14 sealed in an integrated magnetic sheet as shown in FIG. 4B. The lead-out end parts 15 of the sealed coils 14 all face in the same direction.

Subsequently, the cutting step of cutting a magnetic sheet stacked body including coils is executed. As shown in FIG. 4C, the magnetic sheet stacked body with the coils 14 sealed therein is cut together with the lead-out end parts along a first cutting plane parallel to the winding axis direction of the coils and intersecting with the lead-out end parts of each of the coils to form a mounting surface 22. As a result, cut surfaces of the lead-out end parts, i.e., the end surfaces 16 of the lead-out end parts, are arranged on the same plane as the mounting surface 22. In FIG. 4C, the magnetic sheet stacked body is cut along a second cutting plane parallel to the winding axis direction of the coils and orthogonal to the mounting surface 22, in addition to the first cutting plane forming the mounting surface 22, to acquire the magnetic molded bodies 21 each having the two coils 14 incorporated therein. Each of the magnetic molded bodies 21 has the two coils 14 incorporated therein, and the end surfaces 16 of the coils 14 are arranged and exposed on the mounting surface 22 of the magnetic molded body 21. Therefore, the mounting surface 22 is substantially flush with the end surfaces 16 of the lead-out end parts of the coil.

Lastly, the terminal step of forming external terminals is executed. As shown in FIG. 4D, the external terminals 23 are formed on the end surfaces 16 exposed on each of the mounting surfaces 22 to acquire the electronic component 20. The external terminals 23 are formed by applying a paste metal, for example. The external terminals 23 are electrically connected to the end surfaces 16 of the coil 14.

As described above, the electronic component 20 is acquired by executing the multilayer arrangement step, the sealing step, the cutting step, and the terminal step. The electronic component 20 acquired in this way can include two coils with the mounting area equivalent to that of the first example. Furthermore, in such a method of manufacturing the electronic component 20, only the existing step is repeated, so that the electronic component 20 including two coils can be acquired with a small number of man-hours.

Third Example

An electronic component of a third example will be described with reference to FIGS. 5A to 6D. The same reference numerals are given to the constituent elements in common with the already described examples. In the electronic component of the third example, two coils are incorporated in a magnetic molded body such that winding parts thereof are stacked in the winding axis direction of the coils, and an intermediate layer is further disposed between the two coils.

Figure 5A:
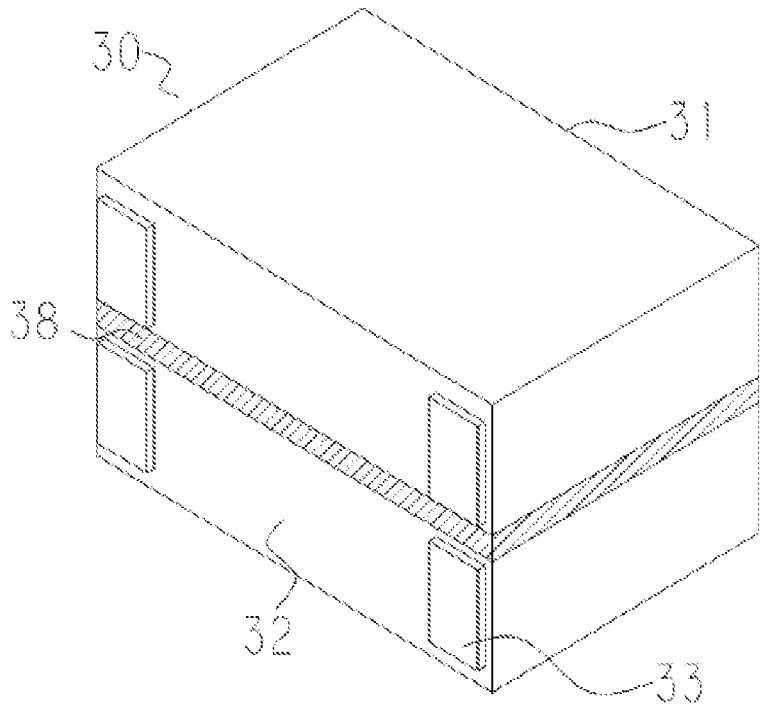
FIG. 5A is a perspective view of an electronic component of a third example.
Figure 5B:
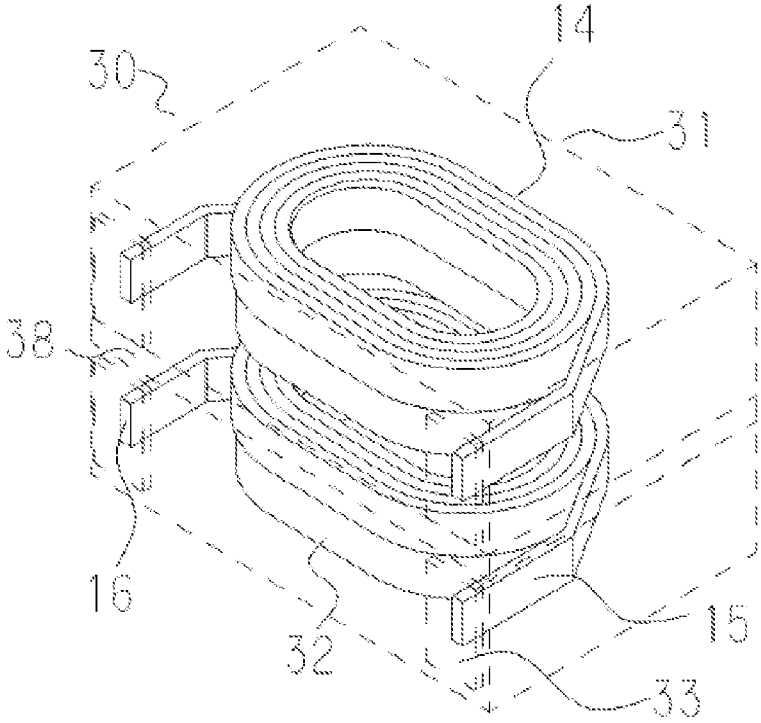
FIG. 5B is a transparent perspective view of the electronic component of the third example.
Figure 6A:
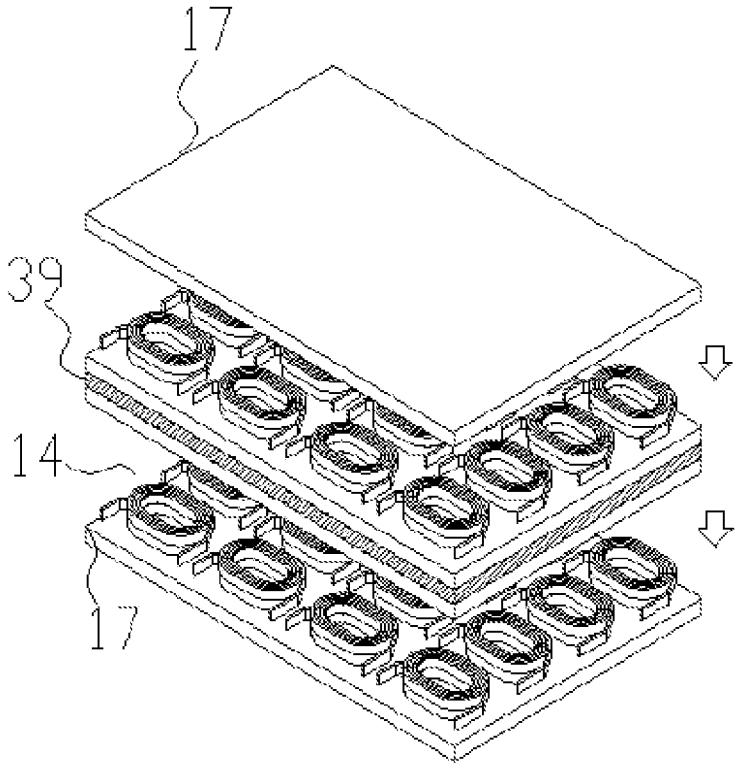
FIG. 6A is a schematic for explaining a method of manufacturing the electronic component of the third example.
Figure 6B:
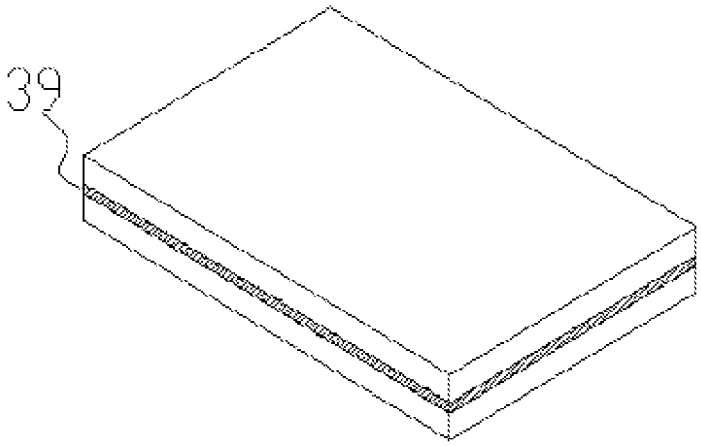
FIG. 6B is a schematic for explaining the method of manufacturing the electronic component of the third example.
Figure 6C:
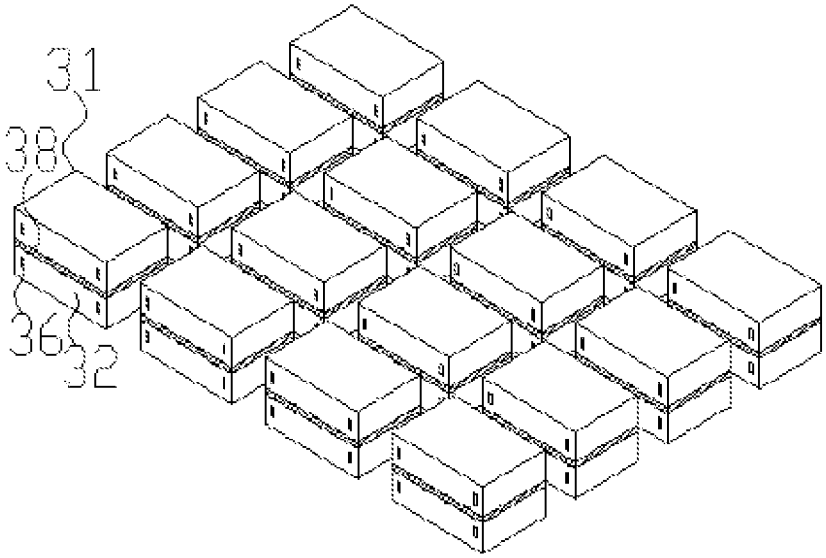
FIG. 6C is a schematic for explaining the method of manufacturing the electronic component of the third example.
Figure 6D:
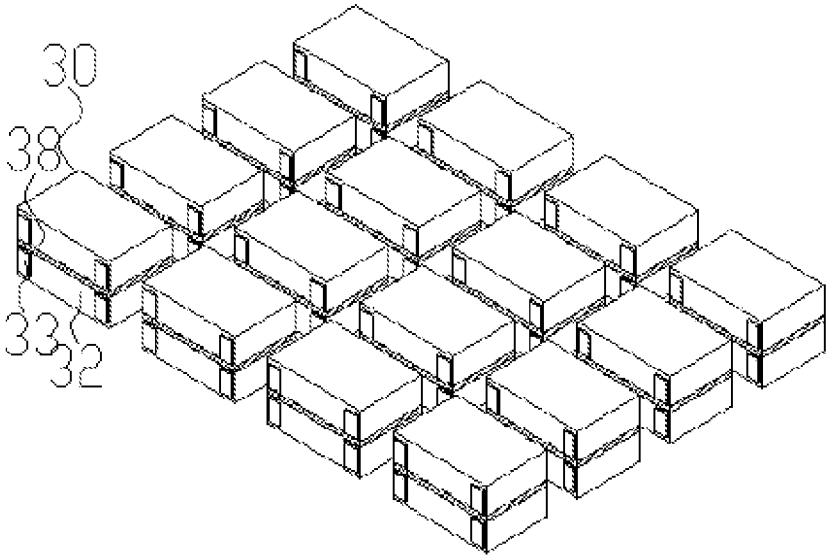
FIG. 6D is a schematic for explaining the method of manufacturing the electronic component of the third example.

FIG. 5A is a perspective view of the electronic component of the third example of this embodiment and FIG. 5B is a transparent perspective view of the electronic component of the third example of this embodiment. FIGS. 6A to 6D are schematics for explaining a method of manufacturing the electronic component of the third example of the present disclosure. FIG. 6A is a perspective view of a multilayer arrangement step of arranging a plurality of magnetic sheets and an intermediate sheet overlapped in the winding axis direction of the coils. FIG. 6B is a perspective view of a sealing step. FIG. 6C is a perspective view of a cutting step. FIG. 6D is a perspective view of a terminal step.

As shown in FIG. 5A, the electronic component 30 of the third example includes a magnetic molded body 31 formed by pressure molding of a mixture of a magnetic powder and a resin. The magnetic molded body 31 includes an intermediate layer 38 and a mounting surface 32 and has external terminals 33 on the mounting surface 32. The intermediate layer 38 is arranged between pairs of the external terminals 33 orthogonally to the mounting surface 32. As shown in FIG. 5B, the two coils 14, each formed by winding a conductive wire having a rectangular cross section, are incorporated inside the magnetic molded body 31. The coil 14 has a winding part of the conductive wire and the lead-out end parts 15 led out from the winding part, and the lead-out end parts 15 are disposed at both ends of the coil 14. The two coils 14 are arranged such that the respective winding parts are stacked in the winding axis direction via a layer containing the magnetic powder and the resin and the intermediate layer. The lead-out end parts 15 are both led out toward the mounting surface and have the respective end surfaces 16 of the conductive wire at tips. The end surfaces 16 are arranged on the same plane as the mounting surface 32 and electrically connected to the external terminals 33. The intermediate layer 38 is arranged perpendicular to the winding axis direction of the coils 14 between the two coils 14.

A method of manufacturing the electronic component of the third example will be described. The electronic component is manufactured by using a magnetic sheet that is a mixture of a magnetic powder and a resin pressure-molded into a flat plate shape, an intermediate sheet of an insulator etc. processed into a flat plate shape, and a coil formed by winding a conductive wire having a rectangular cross section. The intermediate sheet is subjected to pressure molding to form the intermediate layer.

First, the multilayer arrangement step of arranging the coils in multiple layers is executed. As shown in FIG. 6A, a plurality of the coils 14 is arranged on the upper surface of the magnetic sheet 17. The lead-out end parts 15 of the arranged coils 14 are all led out in the same direction. A stacked body is then acquired such that an intermediate sheet 39, a further magnetic sheet 17, and a plurality of the additional coils 14 are stacked in order on the further magnetic sheet 17. The plurality of the additional coils 14 is arranged on the further magnetic sheet 17 in contact therewith and all the lead-out end parts 15 of the arranged coils 14 are led out in the same direction. As shown in FIG. 6A, the acquired stacked body is stacked on the coils 14 arranged on the magnetic sheet 17, and an additional magnetic sheet 17 is further stacked on the additional coils 14 on the stacked body to acquire a stacked precursor. The stacked body is stacked on the coils 14 such that the respective winding parts of the coils 14 arranged on the different magnetic sheets are stacked in the winding axis direction and that all the lead-out parts 15 are led out in the same direction. In the acquired stacked precursor, all the lead-out end parts 15 of the coils 14 arranged on the magnetic sheet are led out in the same direction. The two coils 14 stacked in the winding axis direction have the winding parts stacked via the magnetic sheet 17, the intermediate sheet 39, and the further magnetic sheet 17. On the plurality of the coils 14 arranged on the uppermost stage, the additional magnetic sheet 17 is further stacked and disposed.

The intermediate sheet used in this example is appropriately selected depending on intended characteristics of the intermediate layer to be formed. The intermediate sheet is subjected to pressure molding to form the intermediate layer. Examples of the intermediate sheet include an insulating sheet, a magnetic flux blocking sheet, etc. For example, by using an insulating sheet as the intermediate sheet, the insulation between the coils stacked via the intermediate layer is improved, so that the distance between the stacked coils can be made shorter.

The stacked precursor is formed by stacking the stacked body having the magnetic sheet including the intermediate sheet and the additional coils on the plurality of the coils 14 arranged on the upper surface of the magnetic sheet 17 in FIG. 6A, or may be formed by sequentially stacking on the coils 14, the magnetic sheet 17, the intermediate sheet 39, the further magnetic sheet 17, the coils 14, and the additional magnetic sheet 17. Specifically, the stacked precursor may be formed by sequentially stacking the magnetic sheet 17, the intermediate sheet 39, and the further magnetic sheet 17 on the plurality of the coils 14 arranged on the magnetic sheet 17, arranging the additional coils 14 on the stacked magnetic sheet 17 such that the winding parts are stacked in the winding axis direction via the magnetic sheet 17 and the intermediate sheet 39 and that the lead-out end parts 15 are all led out in the same direction, and stacking the additional magnetic sheet on the arranged additional coils 14. Alternatively, instead of sequentially stacking the magnetic sheet 17, the intermediate sheet 39, and the further magnetic sheet 17, a stacked body acquired by preliminarily stacking these sheets may be stacked on the coils 14 before stacking the additional coils 14 and the additional magnetic sheet on the magnetic sheet 17 to form the stacked precursor.

Subsequently, the sealing step of sealing the coils with a magnetic sheet is executed. The stacked precursor used at the sealing step has a plurality of the coils 14 sandwiched between the two magnetic sheets 17 from both sides in the winding axis direction, and the winding parts of the two coils 14 are stacked via the magnetic sheet 17 and the intermediate sheet 39 in the winding axis direction. The stacked precursor is put into a mold not shown and pressure-molded to acquire a magnetic sheet stacked body having an integrated magnetic sheet stacked via the intermediate sheet 39 and the plurality of the coils 14 sealed in the integrated magnetic sheet as shown in FIG. 6B. The lead-out end parts 15 of the sealed coils 14 all face in the same direction.

Subsequently, the cutting step of cutting a magnetic sheet stacked body including coils is executed. As shown in FIG. 6C, the magnetic sheet stacked body with the coils 14 sealed therein is cut together with the lead-out end parts 15 along a first cutting plane parallel to the winding axis direction of the coils and intersecting with the lead-out end parts of each of the coils to form a mounting surface. As a result, cut surfaces of the lead-out end parts, i.e., the end surfaces 16 of the lead-out end parts, are arranged on the same plane as the mounting surface 32. In FIG. 6C, the magnetic sheet stacked body is cut along a second cutting plane parallel to the winding axis direction of the coils and orthogonal to the mounting surface, in addition to the first cutting plane forming the mounting surface, to acquire the magnetic molded bodies 31 each having the two coils 14 incorporated therein. Each of the magnetic molded bodies 31 has the two coils 14 incorporated therein via the intermediate layer 38, and the end surfaces 16 of the coils 14 are arranged and exposed on the mounting surface 32 of the magnetic molded body 31. Therefore, the mounting surface 32 is substantially flush with the end surfaces 16 of the lead-out end parts of the coil.

Lastly, the terminal step of forming external terminals is executed. As shown in FIG. 6D, the external terminals 33 are formed on the end surfaces 16 exposed on each of the mounting surfaces 32 to acquire the electronic component 30. The external terminals 33 are formed by applying a paste metal, for example. The external terminals 33 are electrically connected to the end surfaces 16 of the coil 14.

As described above, the electronic component 30 is acquired by executing the multilayer arrangement step, the sealing step, the cutting step, and the terminal step. The electronic component acquired in this way can be adjusted in terms of the coupling of the incorporated coils through the intermediate layer disposed between the coils. The distance between the incorporated coils can be shortened because of the insulating intermediate layer disposed between the coils. Furthermore, such a method of manufacturing the electronic component may be implemented by only adding the insulating sheet to the multilayer arrangement step, so that the electronic component with adjusted coupling of the two coils can be acquired with a small number of man-hours.

Fourth Example

An electronic component of a fourth example will be described with reference to FIGS. 7A and 7B. The same reference numerals are given to the constituent elements in common with the already described examples. In the electronic component of the fourth example, three coils are incorporated with winding parts thereof stacked in the winding axis direction of the coils.

Figure 7A:
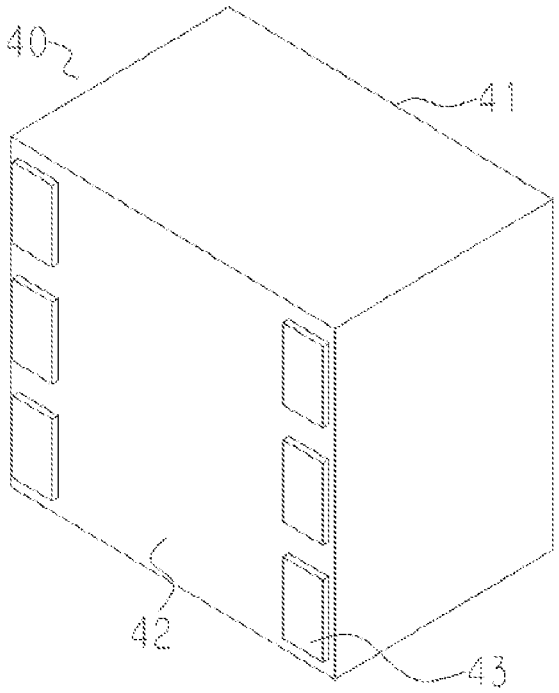
FIG. 7A is a perspective view of an electronic component of a fourth example.
Figure 7B:
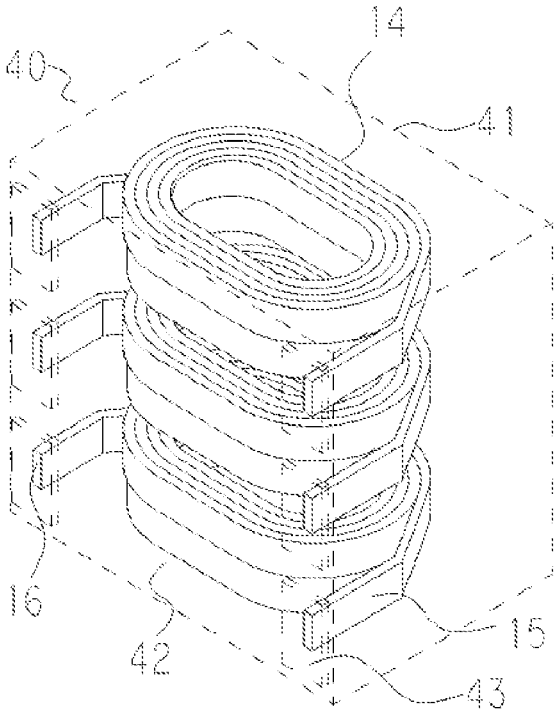
FIG. 7B is a transparent perspective view of the electronic component of the fourth example.

FIG. 7A is a perspective view of an electronic component 40 of the fourth example of this embodiment and FIG. 7B is a transparent perspective view of the electronic component 40 of the fourth example of this embodiment.

As shown in FIG. 7A, the electronic component 40 of the fourth example includes a magnetic molded body 41 formed by pressure molding of a mixture of a magnetic powder and a resin. The magnetic molded body 41 has external terminals 43 on the mounting surface 42. As shown in FIG. 7B, the three coils 14, each formed by winding a conductive wire having a rectangular cross section, are incorporated inside the magnetic molded body 41. The coil 14 has a winding part of the conductive wire and the lead-out end parts 15 led out from the winding part, and the lead-out end parts 15 are disposed at both ends of each coil 14. The three coils 14 are arranged such that the respective winding parts are stacked in the winding axis direction via a layer containing the magnetic powder and the resin. The coils 14 each have the lead-out end parts 15 at both ends. The lead-out end parts 15 are both led out toward the mounting surface and have the respective end surfaces 16 at tips. The end surfaces 16 are arranged on the same plane as the mounting surface 42 and electrically connected to the external terminals 43.

Such an electronic component can be manufactured by simply repeating the arrangement process described above and therefore can be manufactured with a small number of man-hours. Although the number of coils stacked and incorporated in the electronic component is three in FIG. 7B, the number of coils to be stacked is not limited to three, and four or more coils may be stacked and incorporated.

Fifth Example

An electronic component of a fifth example will be described with reference to FIGS. 8A and 8B. The same reference numerals are given to the constituent elements in common with the already described examples. In the electronic component of the fifth example, three coils are incorporated with winding parts thereof stacked in the winding axis direction of the coils, and respective intermediate layers are disposed between the coils.

Figure 8A:
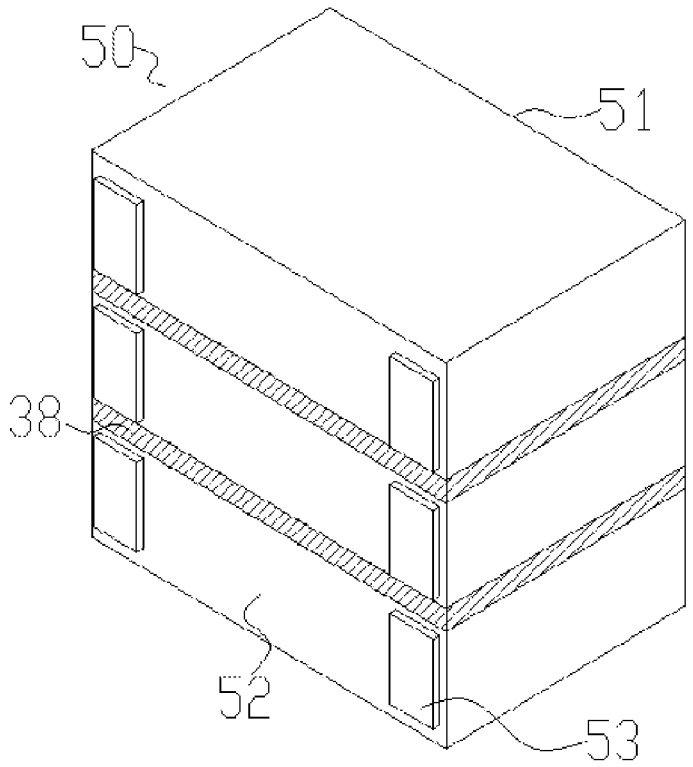
FIG. 8A is a perspective view of an electronic component of a fifth example.
Figure 8B:
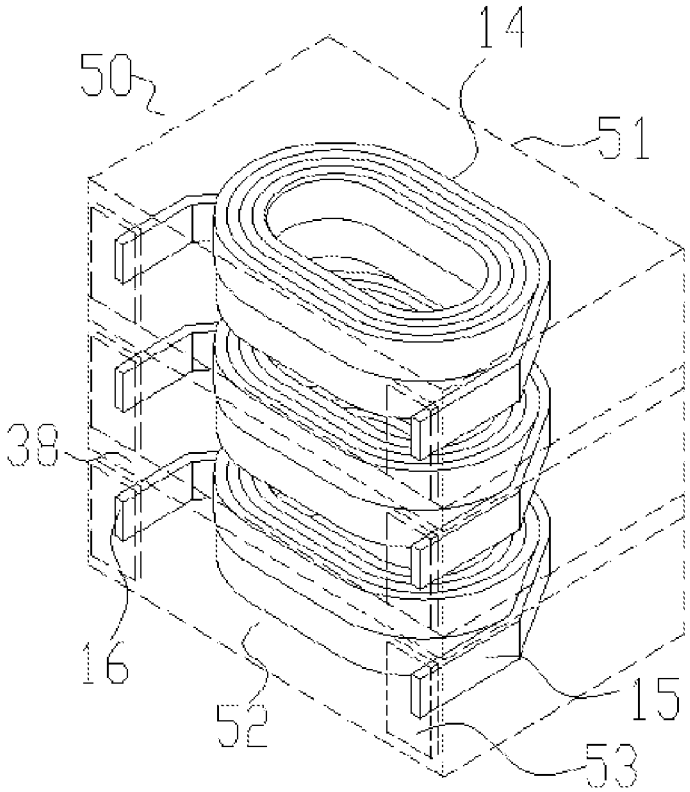
FIG. 8B is a transparent perspective view of the electronic component of the fifth example.

FIG. 8A is a perspective view of an electronic component 50 of the fifth example of this embodiment and FIG. 8B is a transparent perspective view of the electronic component 50 of the fifth example of this embodiment.

As shown in FIG. 8A, the electronic component 50 of the fifth example includes a magnetic molded body 51 formed by pressure molding of a mixture of a magnetic powder and a resin. The magnetic molded body 51 includes the intermediate layers 38 and a mounting surface 52 and the mounting surface 32 has external terminals 53. The intermediate layers 38 are each arranged between pairs of the external terminals 33 orthogonally to the mounting surface 32. As shown in FIG. 8B, the three coils 14, each formed by winding a conductive wire having a rectangular cross section, are incorporated inside the magnetic molded body 51. The coil 14 has a winding part of the conductive wire and the lead-out end parts 15 led out from the winding part, and the lead-out end parts 15 are disposed at both ends of the conductive wire forming the coil 14. The three coils 14 are arranged such that the respective winding parts are stacked in the winding axis direction via a layer containing the magnetic powder and the resin and the intermediate layer. Therefore, the intermediate layers 38 are each disposed between the three coils 14 orthogonally to the winding axis direction thereof. The coils 14 each have the lead-out end parts 15 at both ends of the conductive wire forming the coil. The lead-out end parts are both led out toward the mounting surface and have the respective end surfaces 16 of the conductive wire at tips. The end surfaces 16 are electrically connected to the external terminals 53.

Such an electronic component can be manufactured by simply stacking the intermediate sheets during the multilayer arrangement step and therefore can be manufactured with a small number of man-hours.

Sixth Example

An electronic component of a sixth example will be described with reference to FIGS. 9A and 9B. The same reference numerals are given to the constituent elements in common with the already described examples. In the electronic component of the sixth example, two coils are incorporated with winding parts thereof stacked in the winding axis direction of the coils, and a layer containing the magnetic powder and the resin with dummy external terminals disposed thereon is formed thicker between the coils as compared to the electronic component of the second example.

Figure 9A:
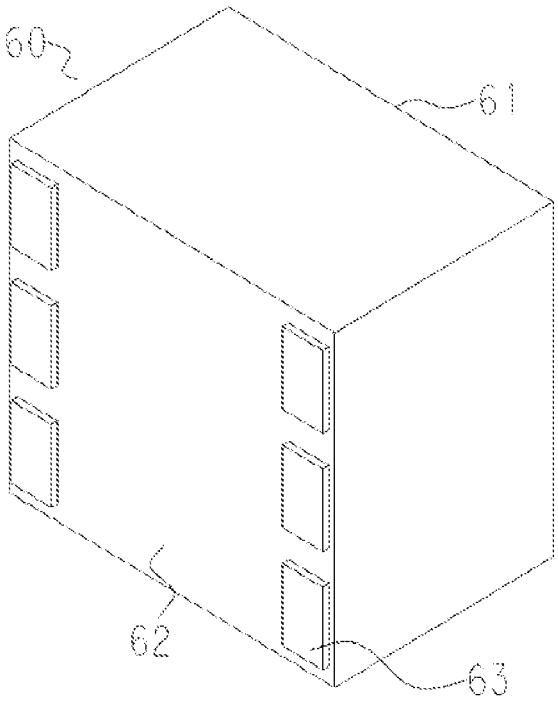
FIG. 9A is a perspective view of an electronic component of a sixth example.
Figure 9B:
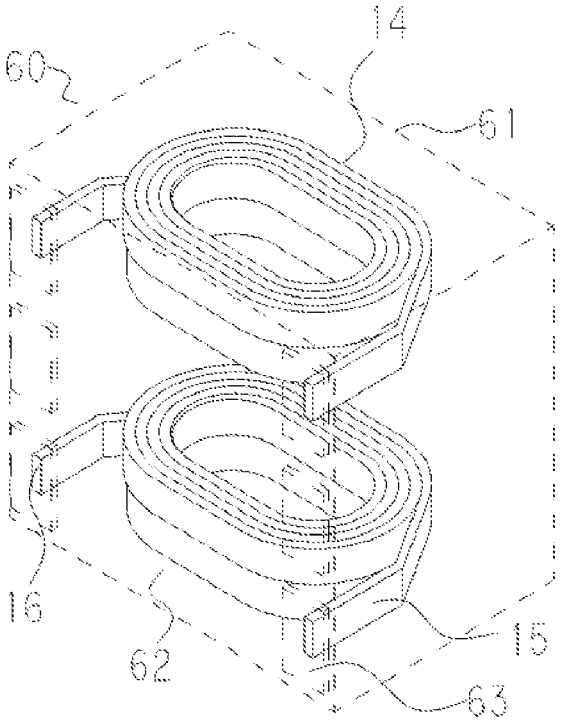
FIG. 9B is a transparent perspective view of the electronic component of the sixth example.

FIG. 9A is a perspective view of the electronic component of the sixth example of this embodiment and FIG. 9B is a transparent perspective view of the electronic component of the sixth example of this embodiment.

As shown in FIG. 9A, an inductor 60 of the sixth example includes a magnetic molded body 61 formed by pressure molding of a mixture of a magnetic powder and a resin. The magnetic molded body 61 has external terminals 63 on a mounting surface 62. The external terminals 63 include four external terminals connected to the coils and two external terminals (also referred to as dummy terminals) not connected to the coils. As shown in FIG. 9B, the two coils 14, each formed by winding a conductive wire having a rectangular cross section, are incorporated inside the magnetic molded body 61. The coil 14 has a winding part of the conductive wire and the lead-out end parts 15 led out from the winding part, and the lead-out end parts 15 are disposed at both ends of the coil 14. The two coils 14 are arranged such that the respective winding parts are stacked in the winding axis direction via a layer containing the magnetic powder and the resin. Between the two coils 14, a pressure-molded body of the magnetic powder and the resin is disposed as a portion of the magnetic molded body 61, and the two external terminals 63 not connected to the coils are arranged on a surface thereof. The coils 14 each have the lead-out end parts 15 at both ends. The lead-out end parts 15 are both led out toward the mounting surface and have the respective end surfaces 16 of the conductive wire at tips. The end surfaces 16 are arranged on the same plane as the mounting surface 62 and electrically connected to the external terminals 63. Although the dummy terminals are disposed in FIG. 9A, the electronic component may be configured without disposing a dummy terminal.

Such an electronic component can be adjusted in terms of the coupling of the coils through the pressure-molded body of the magnetic powder and the resin disposed between the coils. Additionally, such a method of manufacturing the electronic component may be implemented by only eliminating a step of arranging coils in the multilayer arrangement step, so that the electronic component can be manufactured with a small number of man-hours.

It is to be understood that although the present disclosure has been described with regard to preferred embodiments thereof, various other embodiments and variants may occur to those skilled in the art, which are within the scope and spirit of the disclosure, and such other embodiments and variants are intended to be covered by the following claims.

All publications, patent applications, and technical standards mentioned in this specification are herein incorporated by reference to the same extent as if each individual publication, patent application, or technical standard was specifically and individually indicated to be incorporated by reference.

What is claimed is:

1. An electronic component comprising:

at least one coil including a winding part and a pair of lead-out end parts drawn from both ends of the winding part;

a magnetic molded body having a mounting surface with the coil incorporated therein; and a plurality of external terminals formed only on the mounting surface and respectively contacting the end surfaces of the pair of lead out end parts, wherein the winding part is formed by winding a conductor in two tiers, the conductor having a rectangular cross section, a wider surface of the conductor at each end of the conductor being parallel to the winding axis so that both ends of the conductor are located on the outer part of the winding portion, the pair of lead-out end parts are led out toward the mounting surface with the wide surface at each of the pair of lead-out end parts being parallel to each other such that end surfaces of the pair of lead-out end parts are arranged only on the same plane as the mounting surface, the end surfaces of the pair of lead-out end parts are cross sections of the conductor, and the coil is incorporated in the magnetic molded body such that a winding axis of the coil is arranged to be parallel to the mounting surface of the magnetic molded body.

2. The electronic component according to claim 1, comprising a plurality of the coils, wherein at least two of the coils have the respective winding parts stacked in a winding axis direction of the coils.

3. The electronic component according to claim 2, wherein an intermediate layer is disposed between the stacked coils.

4. The electronic component according to claim 3, wherein the intermediate layer comprises an insulating layer having a major surface orthogonal to the mounting surface.

5. The electronic component according to claim 3, wherein the intermediate layer comprises a magnetic flux blocking sheet having a major surface orthogonal to the mounting surface.

6. The electronic component according to claim 3, wherein the intermediate layer is sandwiched by a pair of magnetic sheets.

* * * * *